US010875708B2

(12) United States Patent
Wolfenden

(10) Patent No.: US 10,875,708 B2
(45) Date of Patent: Dec. 29, 2020

(54) AUTOMATED WASTE COLLECTION SYSTEM

(71) Applicant: Alex Wolfenden, Waverley (AU)

(72) Inventor: Alex Wolfenden, Waverley (AU)

( * ) Notice: Subject to any disclaimer, the term of this patent is extended or adjusted under 35 U.S.C. 154(b) by 0 days.

(21) Appl. No.: 16/459,350

(22) Filed: Jul. 1, 2019

(65) Prior Publication Data

US 2020/0002090 A1 Jan. 2, 2020

Related U.S. Application Data

(60) Provisional application No. 62/691,851, filed on Jun. 29, 2018.

(51) Int. Cl.
*B65F 1/14* (2006.01)
*B65F 9/00* (2006.01)
*B65F 1/16* (2006.01)

(52) U.S. Cl.
CPC ..... *B65F 1/1426* (2013.01); *B65F 1/1473* (2013.01); *B65F 1/16* (2013.01); *B65F 9/00* (2013.01)

(58) Field of Classification Search
CPC ..... B65F 1/1426; B65F 1/1473; B65F 1/16; B65F 1/1638; B65F 1/1646; B65F 9/00
USPC ..... 232/43.1, 43.2; 220/908, 908.1
See application file for complete search history.

(56) References Cited

U.S. PATENT DOCUMENTS 3,859,911 A * 1/1975 Karls ..... B30B 9/3032 100/215
3,861,296 A * 1/1975 Clar ..... B30B 9/3032 100/343
4,609,122 A * 9/1986 Ziegenbein ..... B65F 1/1638 220/211
4,883,189 A * 11/1989 Lobbert ..... A61L 11/00 220/260
7,708,188 B2 * 5/2010 Stravitz ..... B65F 1/062 232/43.2
8,678,219 B1 * 3/2014 Wang ..... B65F 1/163 220/211
2007/0182551 A1 * 8/2007 Yang ..... B65F 1/08 340/545.3
2007/0266637 A1 * 11/2007 McGowan ..... B65F 1/1638 49/349
2009/0057317 A1 * 3/2009 Wang ..... B65F 1/1426 220/495.06

(Continued)

FOREIGN PATENT DOCUMENTS

CN 111017434 A * 12/2019

*Primary Examiner* — William L Miller

(57) ABSTRACT

An automated waste collection has a housing, within which is disposed a deployment mechanism for receiving a waste bin. The waste bin may be placed onto the deployment mechanism through an access opening traversing through the housing and selectively obstructed by an access closure. Waste may be deposited within the waste bin through a lid opening at a top of the housing. The deployment mechanism may be displaced by a deployment actuator between a stored position within the housing and a deployed position external to the housing. In order to do so, the deployment mechanism traverses through a deployment opening selectively obstructed by a deployment closure. A controller operates according to a predetermined waste collection schedule, actuating the deployment actuator at any scheduled waste collection times.

13 Claims, 12 Drawing Sheets

(56) References Cited

U.S. PATENT DOCUMENTS

| | | | | |
|---|---|---|---|---|
| 2013/0002100 | A1* | 1/2013 | Badri | A47B 77/18 312/212 |
| 2013/0278067 | A1* | 10/2013 | Poss | B65F 1/1426 307/62 |
| 2014/0172174 | A1* | 6/2014 | Poss | B30B 9/3007 700/275 |
| 2014/0305851 | A1* | 10/2014 | Hubbell | B07C 5/3412 209/583 |
| 2015/0108888 | A1* | 4/2015 | Galimberti | B65F 1/1646 312/270.3 |
| 2016/0347540 | A1* | 12/2016 | Skocypec | B30B 9/3007 |
| 2017/0090447 | A1* | 3/2017 | Skocypec | B65B 67/1238 |
| 2019/0270585 | A1* | 9/2019 | Moore | B65F 1/1473 |

* cited by examiner

AUTOMATED WASTE COLLECTION SYSTEM

The current application claims a priority to the U.S. Provisional Patent application Ser. No. 62/691,851 filed on Jun. 29, 2018. The current application is filed on Jul. 1, 2019, whereas Jun. 29, 2019 and Jun. 30, 2019 were on a weekend.

FIELD OF THE INVENTION

The present invention relates generally to waste storage. More particularly, the present invention relates to a device for storing and automatically deploying collected waste for pickup.

BACKGROUND OF THE INVENTION

In present times, individuals may desire a means to automatically deploying their waste bins for pick-up. In conventional systems, individuals would often leave out their waste bins along the border of their residential/commercial home fronts, curbs, and/or property boundaries for waste pickup. This can be an inconvenience to individuals who forget about their waste-pickup date, and/or for users that are out of town. Additionally, the displaced bins would often be left exposed to the elements, increasing the likelihood for waste bin damage/loss. Oftentimes, individuals would store their waste bins in weather-proof receptacles, stowed away and exclusive from their residential/commercial home fronts, curbs, and/or property boundaries. This conventional system however, does not address the concerns of missing their schedules pick-up waste date, especially for places with dedicated waste pick-up times for various types of waste materials. The present invention aims to solve these problems. The present invention is incorporated within the user's preferred residential/commercial home front, fence, and/or property boundary for easy waste deposit. Additionally, the present invention is also made out of a durable, robust, and weatherproof material that complements the aesthetic appeal to whatever it is incorporated on. Furthermore, the present invention comprises mechanisms and functions that makes it autonomous and programmable to conform to scheduled waste-pick up dates i.e. daily, weekly, fortnightly, etc. Various embodiments of the present invention can also be colored to indicate the scheduling thereof, and/or to indicate designated waste bins based on material wastes such as: paper, plastics, garden refuge, etc. Various embodiments of the present invention can cater to residential/commercial wheelie bin boxes.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention

DETAIL DESCRIPTIONS OF THE INVENTION

Figure 1:
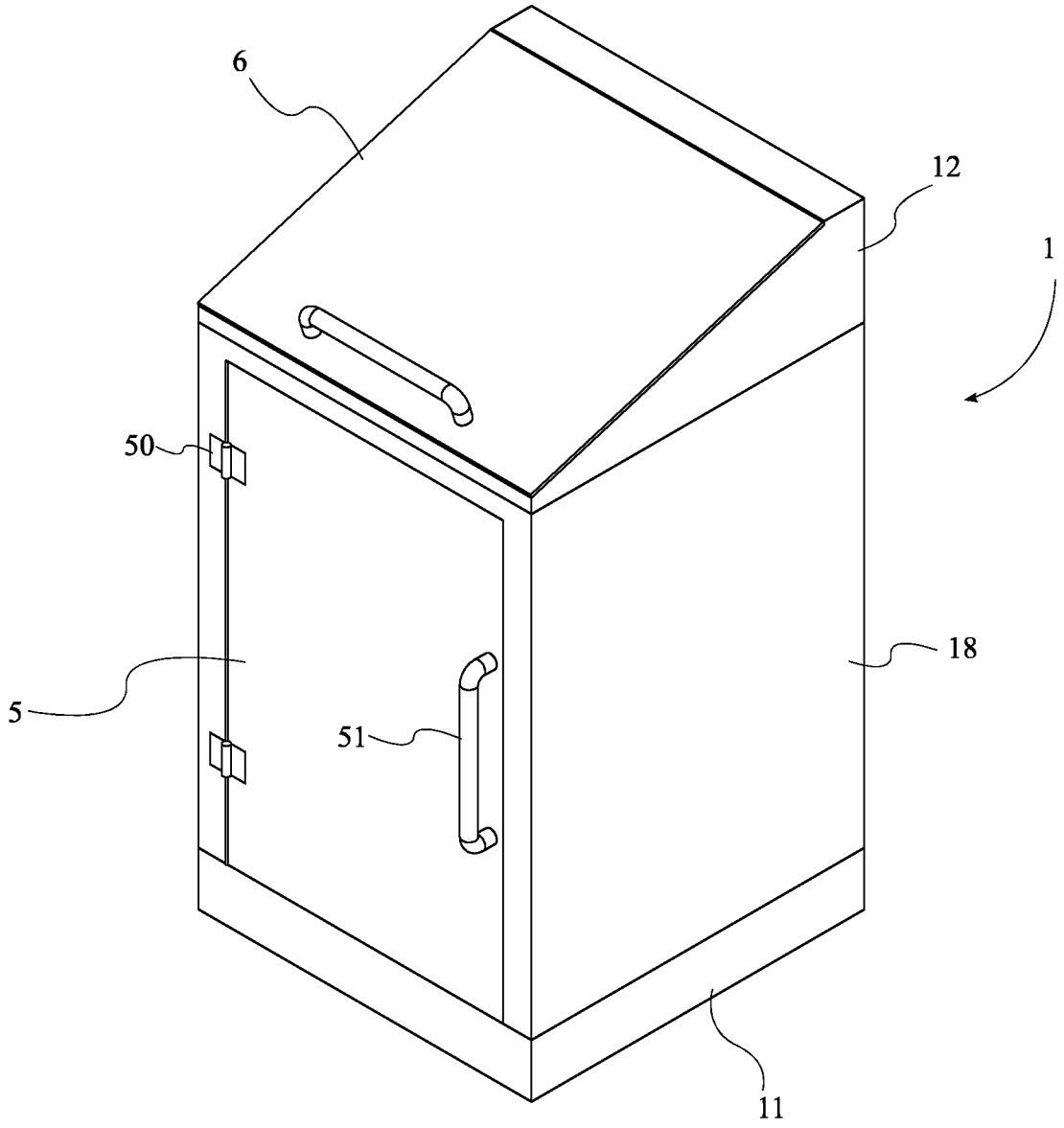
FIG. 1 is a front perspective view of the present invention in accordance with a closed configuration.
Figure 2:
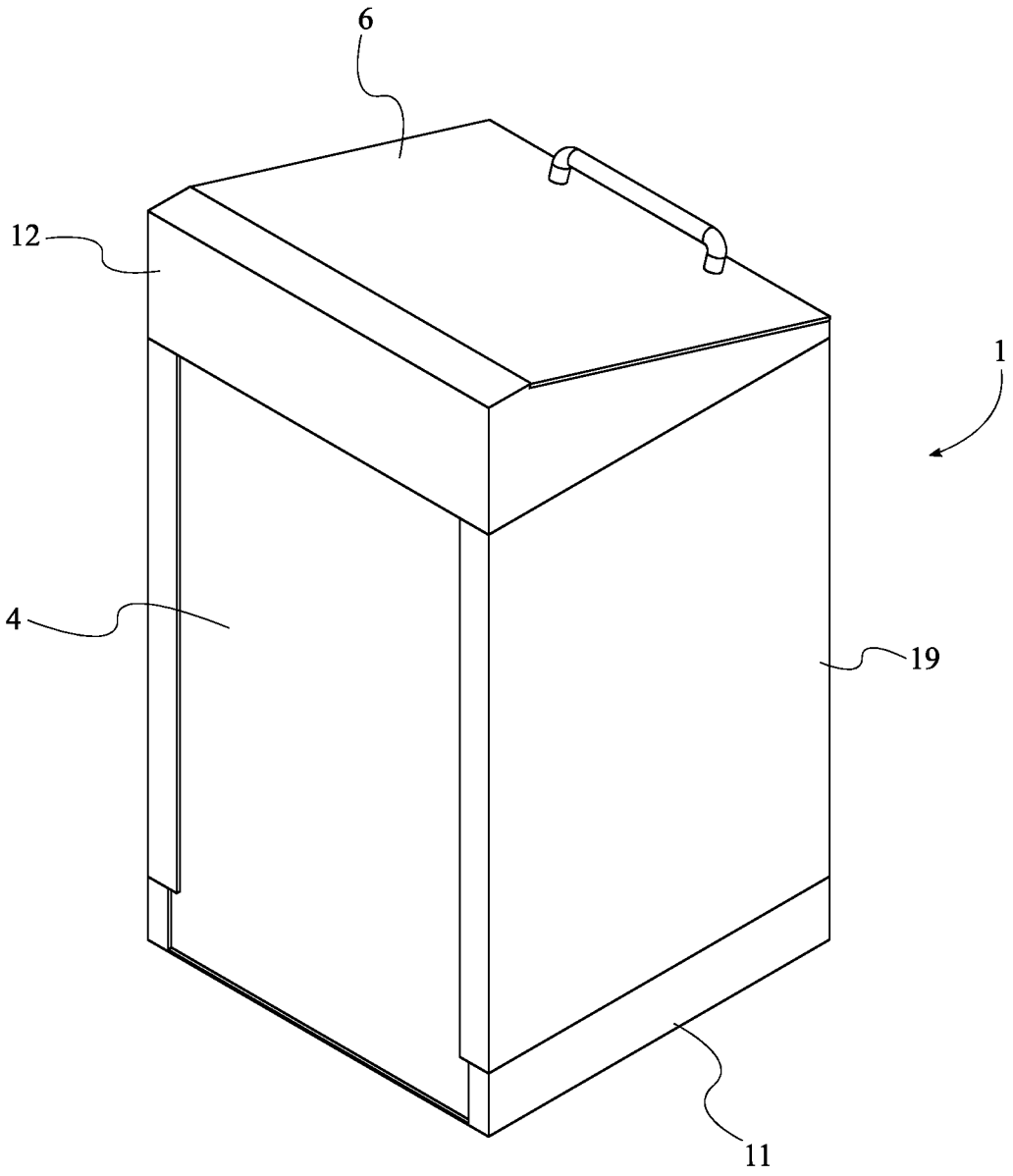
FIG. 2 is a rear perspective view of the present invention in accordance with the closed configuration.
Figure 3:
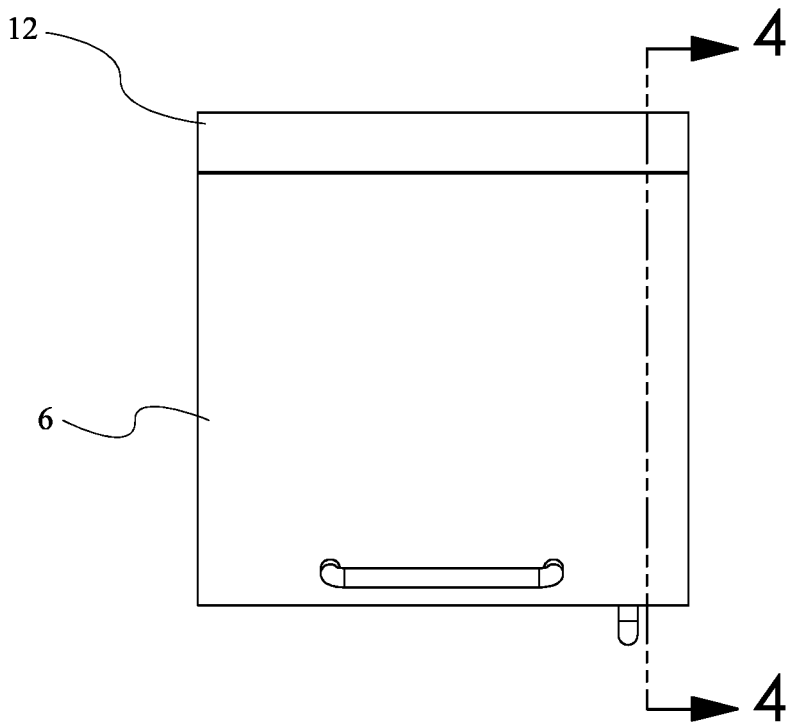
FIG. 3 is a top view of the present invention.
Figure 4:
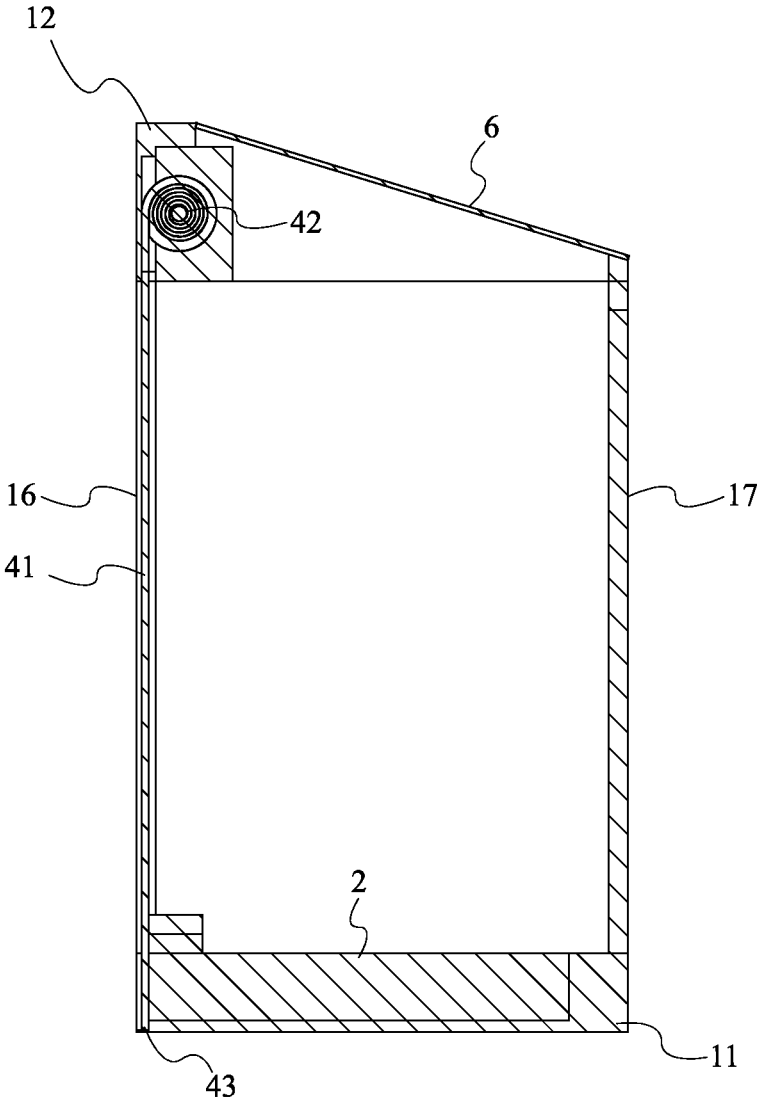
FIG. 4 is a side cross sectional view of the present invention taken along line 4-4 of FIG. 3.
Figure 5:
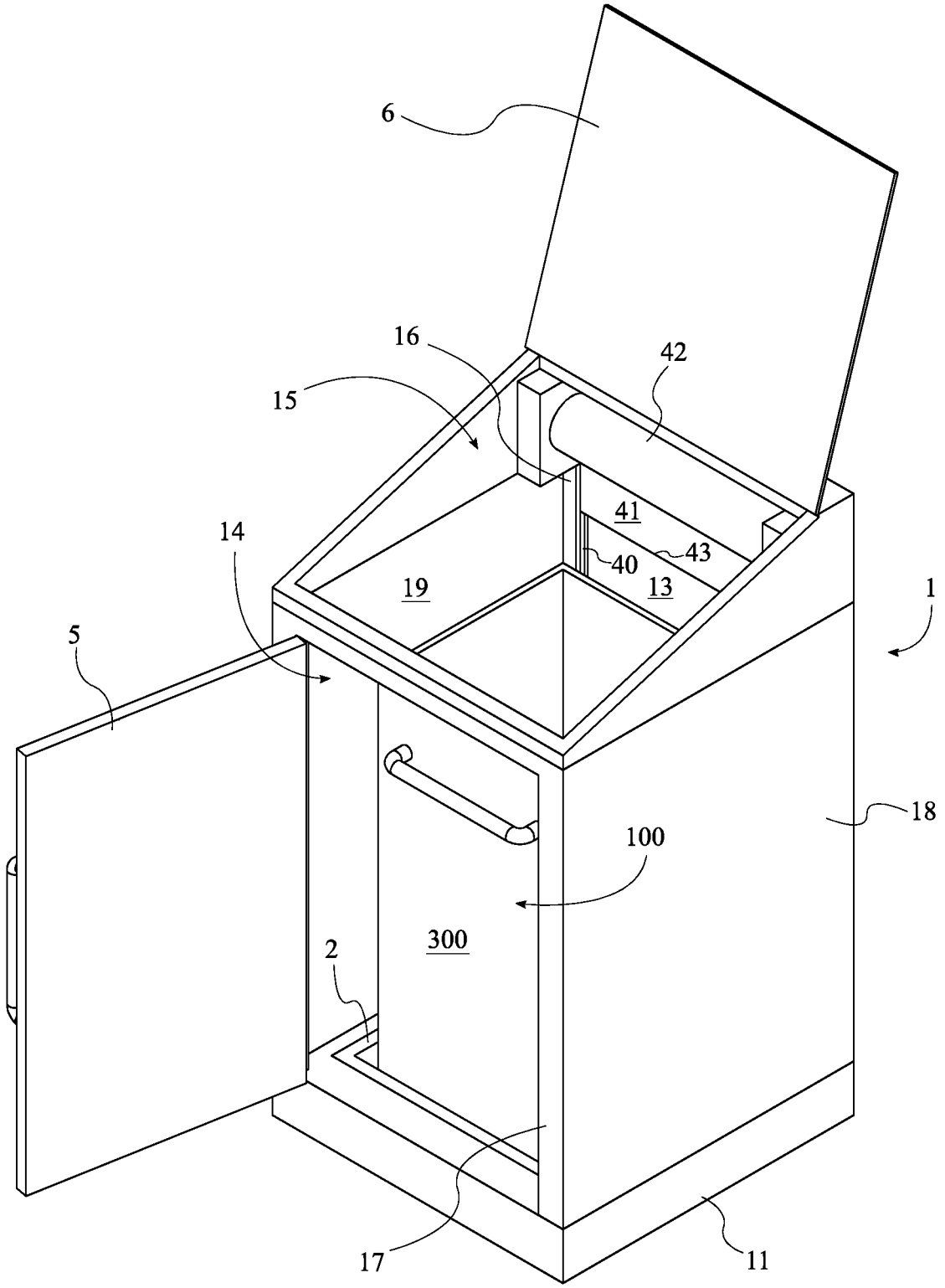
FIG. 5 is a front perspective view of the present invention in accordance with an opened configuration.
Figure 6:
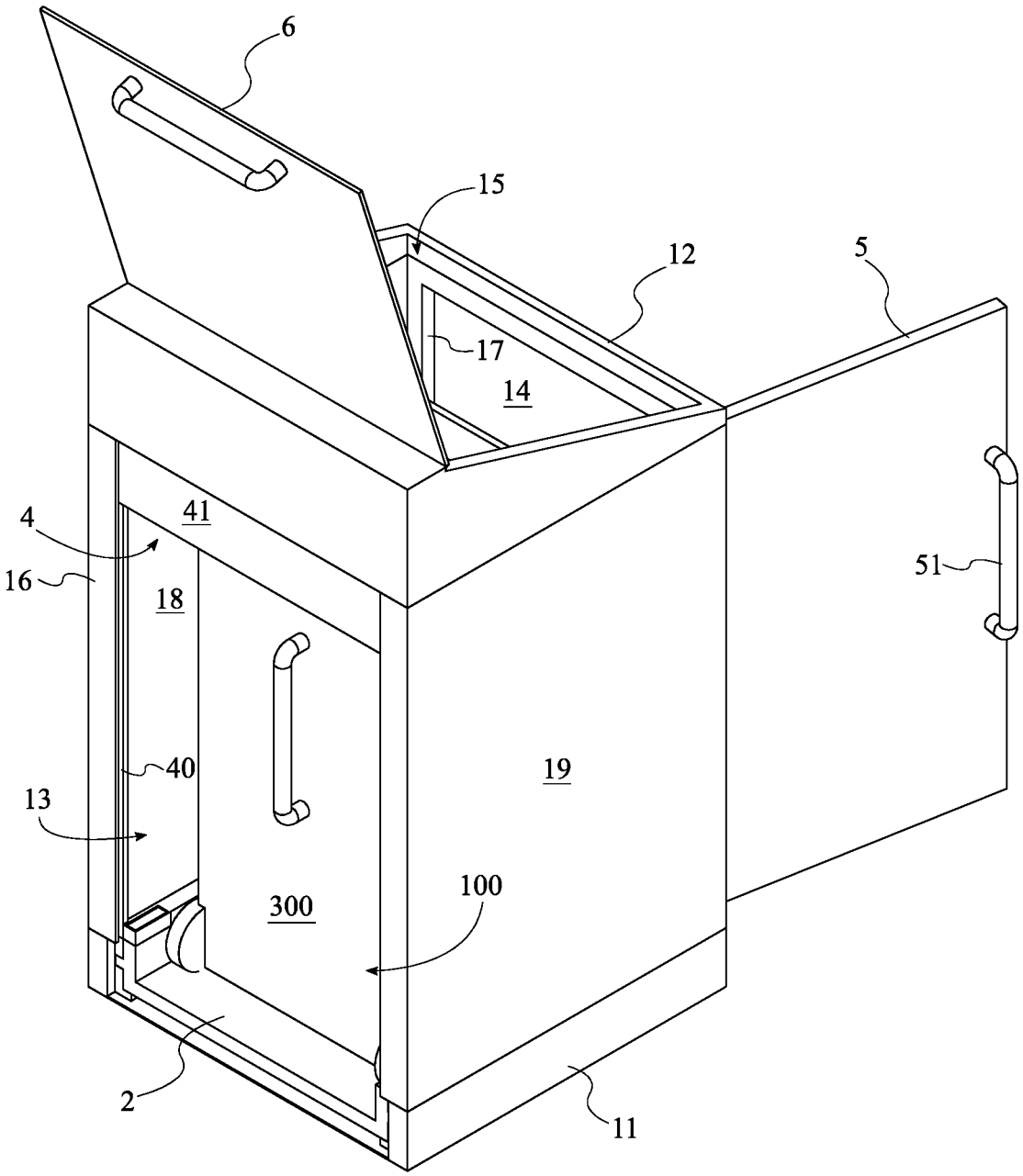
FIG. 6 is a rear perspective view of the present invention in accordance with the opened configuration.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References hereinto "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The present invention is an automated waste collection system. Moreover, the present invention is an enclosure within which users may shelter a waste bin or other compatible receptacle for waste storage and that automatically deploys said receptacle for waste collection according to a designated waste collection schedule.

Referring to FIGS. 1-8 and 10, the preferred embodiment of the present invention comprises a housing 1, a deployment mechanism 2, a deployment actuator 3, a deployment closure 4, an access closure 5, a lid 6, a controller 7, and a power source 8.

The housing 1 is the main structural element of the present invention, and is generally constructed of any robust, weather-proof material that may complement the user's preference. In the preferred embodiment, the housing 1 comprises a base 11, a top 12, a deployment opening 13, an access opening 14, and a lid opening 15. The top 12 is positioned vertically opposite the base 11 along the housing 1. The deployment opening 13 and the access opening 14 traverse longitudinally through the housing 1 between the base 11 and the top 12. Furthermore, the deployment opening 13 and the lid opening 15 are positioned longitudinally opposite each other along the housing 1. The lid opening 15 traverses through the top 12.

The deployment closure 4 is connected to the housing 1 adjacent to the deployment opening 13. The deployment closure 4 is configured to selectively obstruct the deployment opening 13; thus, the deployment closure 4 may be opened or closed in order to reveal or obstruct the deployment opening 13. Similarly, the access closure 5 is connected to the housing 1 adjacent to the access opening 14, wherein the access closure 5 is configured to selectively obstruct the access opening 14. The lid 6 is positioned adjacent to the lid opening 15, wherein the lid 6 is configured to selectively obstruct the lid opening 15. In the preferred embodiment, the lid 6 is hingedly connected to the top 12 of the housing 1. In alternate embodiments, the lid 6 may not be permanently affixed to the housing 1 and may be lifted off the housing 1 in order to reveal the lip opening of the top 12.

In various embodiments, the deployment mechanism 2 may be any mechanism or means through which a waste bin may be received interior to the housing 1 and deployed external to the housing 1. In the preferred embodiment of the present invention, the deployment mechanism 2 is a deployment tray and is a generally flat component intended to receive and support a waste receptacle 300. With a waste receptacle 300 placed onto the deployment mechanism 2 within the housing 1, a user may lift the lid 6 in order to place waste into the waste receptacle 300 through the lid opening 15. The deployment mechanism 2 is positioned adjacent to the base 11, and is operatively engaged with the housing 1 between a stored position 100 and a deployed position 200 as seen in FIGS. 5-8, wherein the deployment mechanism 2 is positioned within the housing 1 in the stored position 100, wherein the deployment mechanism 2 is positioned external to the housing 1 in the deployed position 200, wherein the deployment mechanism 2 traverses through the deployment opening 13 between the stored position 100 and the deployed position 200, and wherein the deployment mechanism 2 is configured to displace a waste bin through the deployment opening between the stored position 100 and the deployed position 200. More particularly, in embodiments wherein the deployment mechanism is a deployment tray, the deployment tray is slidably engaged with the housing 1 between the stored position 100 and the deployed position 200, wherein the deployment tray is positioned within the housing 1 in the stored position 100, wherein the deployment tray is positioned external to the housing 1 in the deployed position 200, and wherein the deployment tray traverses through the deployment opening 13 between the stored position 100 and the deployed position 200.

Figure 7:
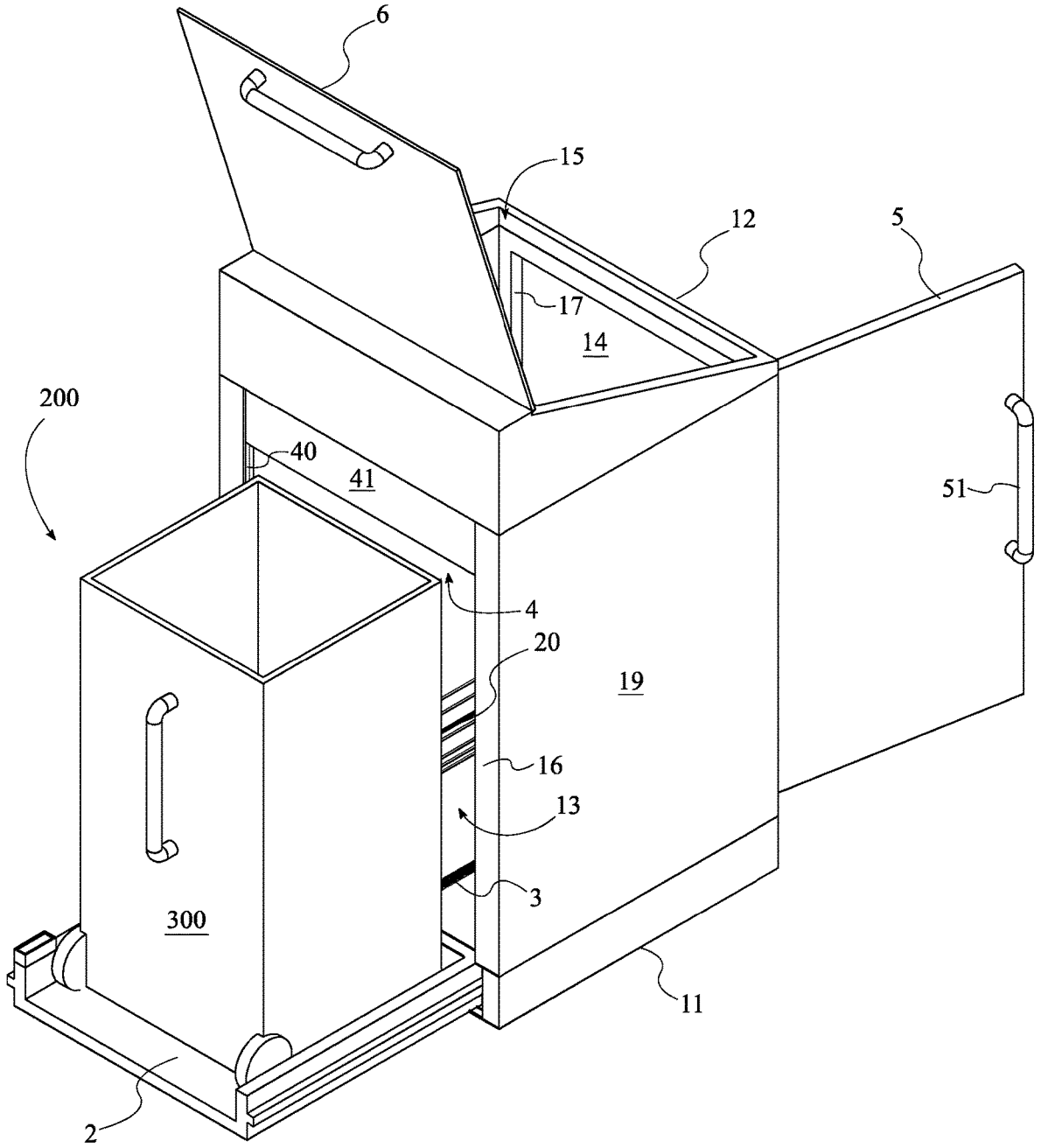
FIG. 7 is a rear raised perspective view of the present invention in accordance with an opened and deployed configuration.
Figure 8:
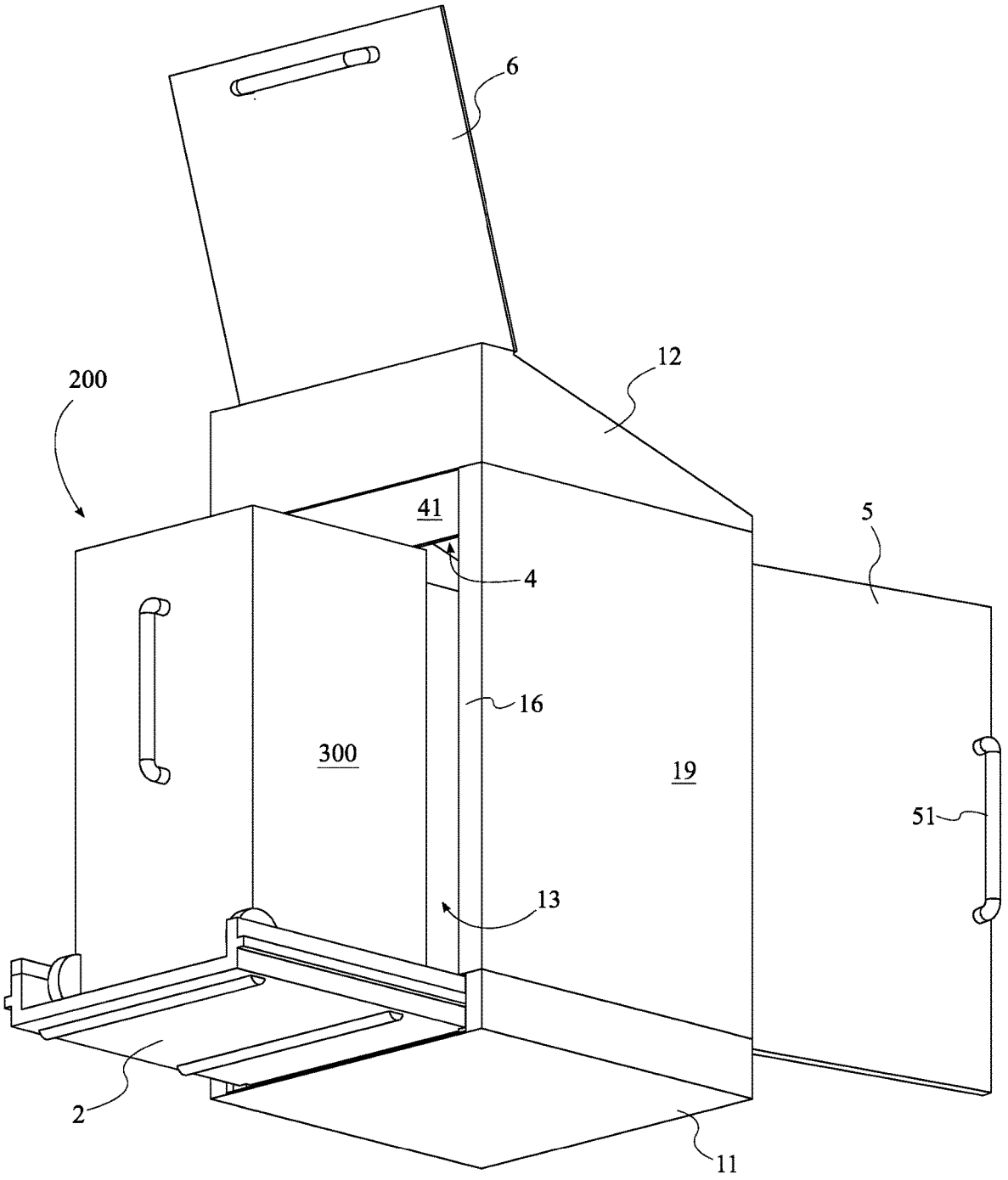
FIG. 8 a rear lowered perspective view of the present invention in accordance with the opened and deployed configuration.

The deployment actuator 3 is operatively engaged between the housing 1 and the deployment mechanism 2, such that the deployment actuator 3 is configured to longitudinally displace the deployment mechanism 2 between the stored position 100 and the deployed position 200. The deployment actuator 3 may take any form of actuator capable of fulfilling the aforementioned purpose, such as, but not limited to, one or more roller actuators, a linear actuator, or other variants of actuators. Furthermore, more than one deployment actuator 3 or combinations of different variations of actuators may be utilized to serve said purpose in various embodiments as known to those skilled in the art. The deployment mechanism 2 may further comprise rollers connected to the underside of the deployment mechanism 2 in order to aid its movement and reduce friction with the base 11. In some embodiments, the deployment actuator 3 may be a linear actuator utilizing a lead screw driven by a motor and engaged with the deployment tray in order to extend and retract the deployment tray, as illustrated in FIG. 7.

Figure 10:
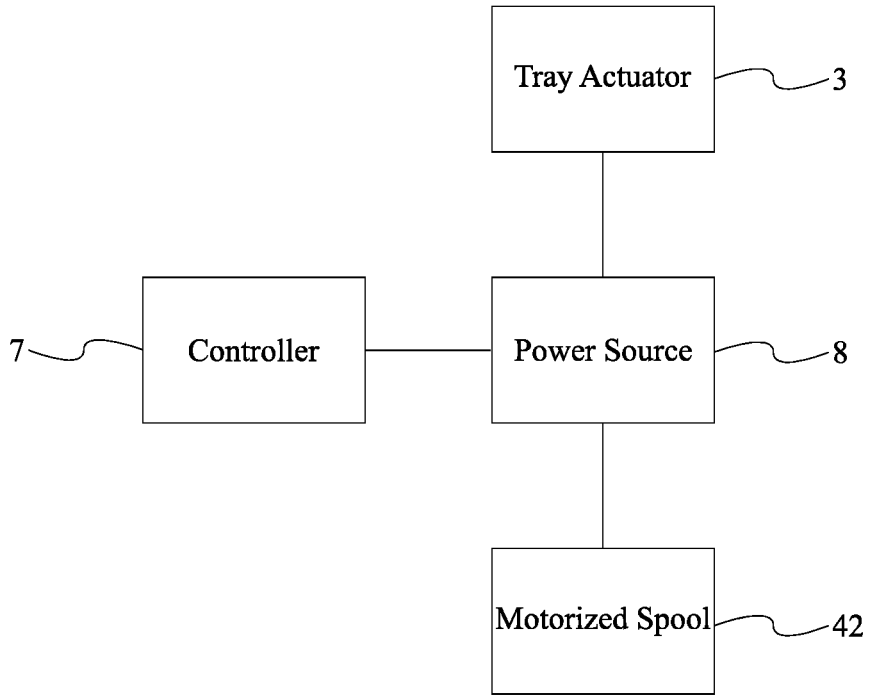
FIG. 10 is a diagram depicting the primary electronic components of the present invention in the preferred embodiment.

In reference to FIG. 10, the power source 8 may be any available and applicable power source 8, such as, but not limited to, a rechargeable and/or removable battery, or a wired connection to a typical household electrical socket, or other applicable power sources. The power source 8 is electrically connected to the deployment actuator 3 and the controller 7, and to any other electrical components of the present invention which require electrical power to operate. More than one power source 8 may be utilized for different components of the present invention as desired.

The controller 7 is the electronic control and communication processing center of the present invention, comprising one or more electrical, electronic and/or processing devices such as, but not limited to, printed circuit boards (PCBs), microcontroller 7*s*, integrated circuits, resistors, capacitors, or any other electrical or electronic components suitable for facilitating the purpose of the present invention. The controller 7 is electronically connected to the deployment actuator 3 and to any other electrical or electronic components of the present invention which may require electrical or electronic control.

It is contemplated while the housing 1 may take any form suitable to facilitating the purpose of the present invention, in the preferred embodiment the base 11 further comprises a deployment frame 16, an access frame 17, a first lateral wall 18, and a second lateral wall 19. The deployment frame 16, the access frame 17, the first lateral wall 18, and the second lateral wall 19 are connected between the base 11 and the top 12. In some embodiment, the deployment frame 16 and the access frame 17 are oriented parallel to each other, while the first lateral wall 18 and the second lateral wall 19 are oriented parallel to each other. In some embodiments, the first lateral wall 18 and the second lateral wall 19 are perpendicularly and terminally connected between the deployment frame 16 and the access frame 17. The deployment closure 4 traverses through the deployment frame 16, and the access closure 5 traverses through the access frame 17.

In various embodiments, the particular means through which the deployment mechanism 2 is displaced between the stored position 100 and the deployed position 200 may vary. However, in the preferred embodiment, to this end, the present invention further comprises a plurality of rails 20. The plurality of rails 20 is oriented longitudinally and connected within the housing 1. In embodiments where the deployment mechanism 2 comprises a deployment tray, the deployment mechanism 2 is slidably engaged with the plurality of rails 20, such that the deployment mechanism 2 is displaced between the stored position 100 and the deployed position 200 along the plurality of rails 20. In the preferred embodiment, each of the plurality of rails 20 is laterally connected internal to the base 11. More particularly, in the preferred embodiment, the plurality of rails 20 is a pair of rails that is positioned laterally opposite each other along the base 11.

The preferred embodiment of the present invention further comprises at least one closure hinge 50. The at least one closure hinge 50 is connected to the access frame 17 of the housing 1 adjacent to the access opening 14, and the access closure 5 is hingedly connected to the housing 1 through the at least one closure hinge 50, forming a door closure through which the access opening 14 may be revealed or obstructed. Furthermore, a closure handle 51 is connected to the access closure 5 and positioned external to the housing 1, enabling a user to easily manipulate the access closure 5 about the at least one closure hinge 50.

In the preferred embodiment, the deployment closure 4 is an unfurling closure comprising a closure body 41 and a motorized spool 42. The closure body 41 is deployably wound around the motorized spool 42, wherein the motorized spool 42 is configured to selectably deploy or retract the closure body 41 in order to obstruct or reveal the deployment opening 13, respectively. The motorized spool 42 is configured to reversibly rotate about its axis in order to deploy and retract the closure body 41. The motorized spool 42 is electrically connected to the power source 8, and the motorized spool 42 is electronically connected to the controller 7. Thus, the controller 7 may actuate the motorized spool 42 in order to deploy or retract the closure body 41 in order to obstruct or reveal the deployment opening 13, respectively. In the preferred embodiment, the motorized spool 42 is laterally mounted within the housing 1 adjacent to the deployment frame 16 and adjacent to the top 12 of the housing 1. Thus, the deployment closure 4 opens and closes in a manner similar to a typical garage door. In order for the closure body 41 to be wound around the motorized spool 42, the closure body 41 may be made of a flexible, yet durable material, or the closure body 41 may consist of a plurality of segments rotatably, terminally and serially connected to each other, or through another viable means.

In the preferred embodiment, in order to support the intended operation of the deployment closure 4, the deployment frame 16 comprises a pair of tracks 40. The pair of tracks 40 traverses into the deployment frame 16 between the top 12 and the base 11 and is positioned laterally opposite each other along the deployment frame 16. A distal end 43 of the closure body 41, which is opposite the motorized spool 42 along the closure body 41, is positioned within the pair of tracks 40, wherein the motorized spool 42 is configured to displace the distal end 43 of the closure body 41 toward the base 11 within the pair of tracks 40 in order to obstruct the deployment opening 13, and vice versa to reveal the deployment opening 13.

The general process of use of the present invention is as follows. The user manually opens the access closure 5 and places a waste receptacle 300 into the deployment mechanism 2 through the access opening 14. Then, the user may open the lid 6 and place waste into the waste receptacle 300 through the lip opening at the top 12 of the housing 1. A predetermined deployment schedule may be established through a variety of means. For example, a wireless communication device may further be comprised in the present invention in order to facilitate electronic communication of the controller 7 with a mobile application of the user's mobile device or desktop computer, or with a remote server, or other means of control. The user may be able to input the deployment schedule through an interface of the mobile or desktop application, web browser, or similar means, or the deployment schedule may be received electronically from a third party. Alternatively or additionally, the user may be enabled to input a command through the mobile application or other interface in order to deploy the deployment mechanism 2 at any time. The deployment schedule may comprise one or more deployment date-and-times. At each deployment date-and-time, the controller 7 actuates the motorized spool 42 in order to retract the closure body 41 of the deployment closure 4, revealing the deployment opening 13. Subsequently, the controller 7 actuates the deployment actuator 3 in order to displace the deployment mechanism 2 into the deployed position 200, exposing the waste receptacle 300, which may then be emptied or collected by waste collection workers. In some embodiments of the present invention, the controller 7 can be programmed to extend the deployment mechanism 2 to varying distances to accommodate limited spaced residential home fronts/commercial properties. Finally, after the waste receptacle 300 is repositioned within the deployment mechanism 2, the deployment mechanism 2 is returned to the stored position 100.

Figure 9:
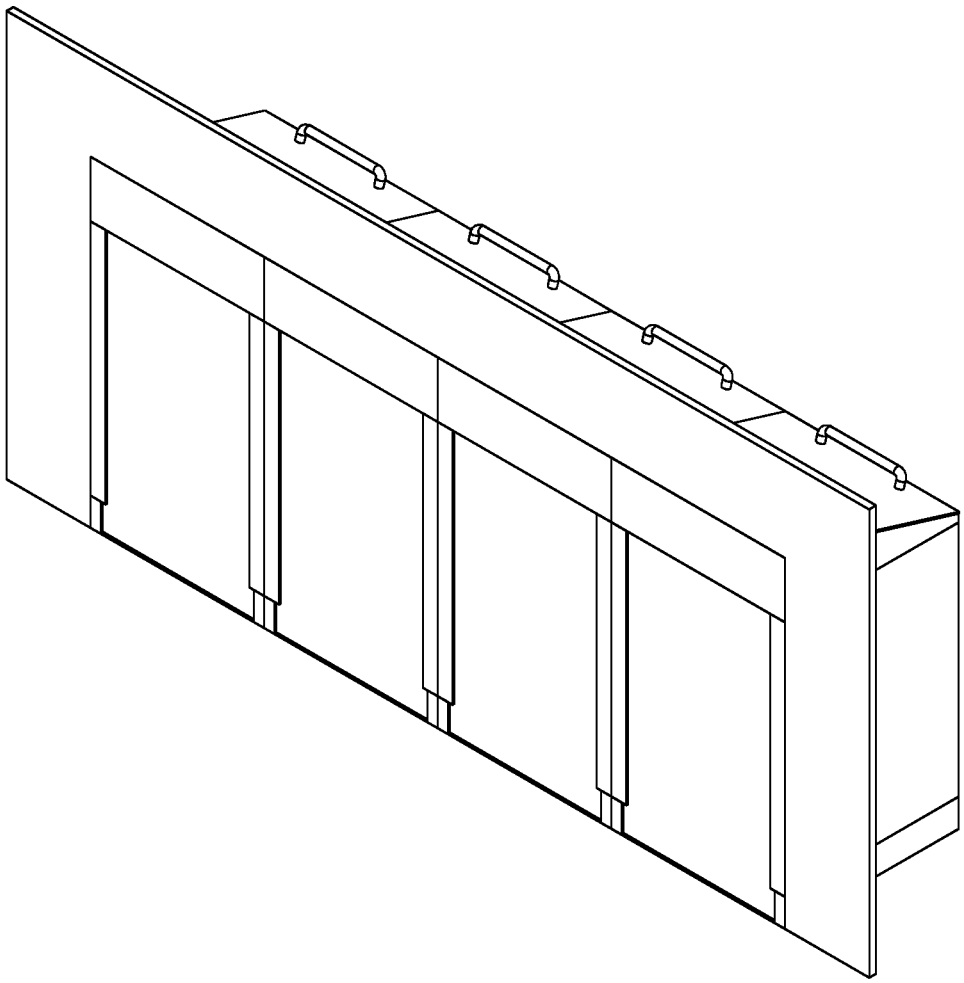
FIG. 9 is a rear raised perspective view of multiple instances of the present invention installed into a wall.

It may be further noted herein that multiple instances of the present invention may be arranged along a wall, fence or other boundary of the user's residential home front or commercial property, or in any other desired location, as illustrated in FIG. 9.

The following is an alternate, exemplary description of the present invention and is intended to further demonstrate the spirit of the present invention along with various details which may be implemented in different embodiments and should not be considered to be limiting.

The present invention is a holder assembly. More specifically, the holder assembly is an automatic waste storage system that enables users to shelter any compatible bin box within the holder assembly. Additionally, the holder assembly automatically deploys the bin box through a set schedule and/or wireless interaction. In the preferred embodiment of the present invention, a plurality of holder assemblies can be incorporated within the wall, and/or fence of the user's residential home front/commercial property, where each holder assembly is a standalone unit. In various embodiments of the present invention, the plurality of holder assemblies can be used for bins collected on different days, i.e. daily, weekly, fortnightly, etc. where the plurality of holder assemblies is programmed as such. In various embodiments of the present invention, the bins can be colored to indicate the scheduling of said plurality of holder assemblies, and/or to indicate designated waste bins based on material wastes such as: paper, plastics, garden refuse, etc.

In the preferred embodiment of the present invention, the holder assembly is constructed out of any robust, weatherproof material that compliments the user's preference. The holder assembly comprises: a base, a chassis, a lid, a first door, a second door, a controller, and a cloud. The base is the foundation of the holder, directly adjacent to the ground. More specifically, the base serves as the bottom housing of the bin. Additionally, the base serves as the platform for the shuttle, such that the shuttle can traverse in and out of the holder assembly. The base comprises: a case, a shuttle, and a first sensor. The case is the main body of the base. More specifically, the case houses the shuttle and the controller. In the preferred embodiment of the present invention, the case is made out of any durable weatherproof material that compliments the aesthetic appeal of the holder assembly. The case further comprises: a cavity, and a plurality of channels. The cavity is the internal cut-out of the case that conforms and flushes the shuttle. More specifically, the cavity houses the movable shuttle assembly within the base of the holder assembly. The plurality of channels is incorporated on the sides of the cavity, and flushes with the shuttle. More specifically, the plurality of channels serves as guides for the movable shuttle such that the shuttle can traverse in and out of the base.

The shuttle resides in the cavity portion of the base. Additionally, the shuttle is wired on to the controller assembly. More specifically, the shuttle is the movable platform of the base that allows the waste bin to traverse in and/or out of the holder assembly. In the preferred embodiment of the present invention, the shuttle takes form of a trolley-style linear actuating system but can be any type of feasible linear actuating system that can traverse the bin in and/or out of the holder assembly. In another embodiment of the present invention, the shuttle can take form of a forklift mechanism incorporated under the lid rim, such that the bin is picked up and deployed outside the holder before retracting. The shuttle comprises: a driver, a plurality of rails, a tray, and a ramp. The driver is directly adjacent to the cavity portion of the base. More specifically, the driver is the linear actuating mechanism that traverses the shuttle in and/or out of the holder assembly. In the preferred embodiment of the present invention, the driver can take form of a set of roller actuators, but can be any type of feasible linear actuating mechanism that can traverse the shuttle in and/or out of the holder assembly. The plurality of rails conforms and aligns the plurality of channels. More specifically, the plurality of rails guides the shuttle in and/or out of the base.

The tray is opposite to the driver end of the shuttle. More specifically, the tray serves as the bin platform. The ramp is directed to the home-front end of the shuttle assembly. More specifically, the ramp is an access opening for the wheelie bin to roll off of the shuttle. The first sensor is installed on the tray end of the shuttle, opposite to the driver. Additionally, the first sensor resides on the ramp end of the shuttle. Furthermore, the first sensor is wired on to the controller module. More specifically, the first sensor is a proximity sensor that sends a signal to the controller that the first door is opened/ajar.

The chassis proceeds the base of the holder assembly. More specifically, the chassis is the main body of the holder assembly that houses and/or conceals the waste bin. Additionally, the chassis serves as a platform for the lid. In various embodiments of the present invention, the chassis can be made out of any preferable durable and weatherproof material that compliments the aesthetic appeal of the holder assembly. The chassis further comprises: a first frame, a second frame, a first wall, and a second wall. The first frame is located on the residential home front/commercial property end of the holder assembly, directed outside of the residential home front/commercial property. More specifically, the first frame of the chassis serves as the access opening panel for the bin to traverse in and/or out of the holder assembly. Additionally, the first frame serves as the platform for outfitting the first door. In the preferred embodiment of the present invention, the first frame caters to a vertical roller door configuration. In various embodiments of the present invention, the first frame can cater to any type of door configuration, i.e. roller, French door, double concertina style door, etc. The first frame further comprises a plurality of cuts. The plurality of cuts traverses the first frame access opening, from the base to the chassis end of the holder assembly. More specifically, the plurality of cuts serves as guides for the first door. The second frame is directed inside of the residential home front/commercial property boundary, opposite to the first frame. More specifically, the second frame of the chassis serves as the access opening panel for the second door.

The first wall traverses from the first frame and the second frame. Additionally, the first wall is adjacent to the first sensor end of the shuttle. More specifically, the first wall is the closed off section of the chassis that houses and conceals the bin. The second wall traverses from the first frame and the second frame, opposite to the first wall. More specifically, the second wall is the closed off section of the chassis that houses and conceals the bin. The lid proceeds the chassis, and is opposite to the base portion of the holder assembly. More specifically, the lid serves as a cap for the open top chassis, such that it secures and conceals the bin from the top. Additionally, the lid serves as the platform for the first door, such that the first door aligns and flushes with the first frame. Furthermore, the lid serves as an access opening, such that the user can throw away appropriate waste in the bin from the top.

The lid comprises: a ridge, a first hinge, a hatch, and a first handle. The ridge is positioned near the first frame side of the lid. More specifically, the ridge serves as the connection platform for the lid and the first door. The ridge further comprises: a brim, and a bracket. The brim is located on the outside of the ridge. Additionally, the brim is flushed with the residential home front wall and/or commercial property boundary. More specifically, the brim portion of the lid serves as the connection platform for the hatch to secure on to. The bracket resides in the lid, directly below the brim side of the ridge. More specifically, the bracket serves as the attachment platform for the first door.

The first hinge traverses the brim portion of the ridge. More specifically, the first hinge serves as a connection member to attach the hatch on to the brim side of the lid. Additionally, the first hinge allows the attached hatch to swivel along the brim side of the lid. The hatch is attached on to the first hinge. Additionally, the hatch traverses from the ridge end of the lid to the second frame end of the lid. More specifically, the hatch serves as an accessible cover for the lid where the user can lift the hatch off the second frame side of the lid to throw away waste into the bin.

The first handle is attached on to the lid, near the second frame. More specifically, the first handle allows the user to grip and lift the hatch open from the lid. The first door resides in the bracket portion of the lid. Additionally, the first door traverses from the lid to the base end of the holder assembly. Furthermore, the first door conforms and aligns to the plurality of cuts of the first frame such that the first door can easily traverse open and/or closed on to the first frame. More specifically, the first door is the front roller or double French door system that conceals and secures the access opening of the first frame. In the preferred embodiment of the present invention, the first door takes form of a vertical roller door system. In various embodiments of the present invention, the first door can be any viable means of working in conjunction with the first frame, i.e. a roller door, double French door, double concertina style door, etc.

In the preferred embodiment, the first door further comprises: a spool, a sheet, a skirt, and a second sensor. The spool resides in the bracket portion of the lid. Additionally, the spool is wired on to the controller. More specifically, the spool is the roller door actuator that extends, and/or retracts the sheet from the lid end of the holder assembly to the base end of the holder assembly. The sheet conforms and aligns with the plurality of cuts located on the first door. Additionally, the sheet traverses from the lid to the door end when fully extended. Furthermore, the sheet retracts within the spool, such that it provides enough clearance for the bin to traverse through the first frame. More specifically, the sheet is the roller door cover that secures and conceals the access opening of the first frame. The sheet further comprises a skirt. The skirt is directly adjacent and flushed with the base end of the holder assembly when the sheet it fully extended. More specifically, the skirt is the end of the sheet that serves as a weatherproof seal between the sheet and the base.

In the preferred embodiment, the second sensor is attached on to the skirt. Additionally, the second sensor conforms and aligns to the first sensor. More specifically, the second sensor works in conjunction with the first sensor, such that it indicates when the first door is opened when the second sensor is not flushed with the first sensor. Additionally, the second sensor indicates when the skirt is flushed with the base when the second sensor is flushed with the first sensor.

The second door resides in the access opening of the second frame. More specifically, the second door serves as an accessible cover such that the user can access the bin from the second frame side of the holder assembly. The second door comprises: a gate, a second hinge, and a second handle. The gate traverses the access opening of the second door. More specifically, the gate serves as the cover panel that secures and conceals the access opening of the second frame. The second hinge attaches on to the gate and the second frame. More specifically, the second hinge attaches the gate on to the second door, such that the gate pivots along the second hinge when the gate is opened. The second handle is fixed on to the gate, opposite to the second hinge. More specifically, the second handle allows the user to grip and open the gate from the second frame.

The controller resides in the case portion of the base. More specifically, the controller is the computing module of the holder assembly that manipulates the shuttle and the first door of the holder assembly autonomously based on a set schedule and/or wireless manipulation. The autonomous functions of the controller are programmed within the cloud, wherein the controller communicates with the actuator to deploy the bin out for waste pickup. Additionally, the controller module powers the holder assembly. In the preferred embodiment of the present invention, the controller manipulates the first door, such that it activates the spool to retract the sheet along the plurality of cuts, exposing the access opening such that the bin can traverse through the first frame. The controller then activates the driver actuator to deploy the shuttle out of the first frame, exposing the bin for waste pick-up. In another embodiment of the present invention, the controller can be programmed to manipulate the driver to deploy the bin in varying distances to accommodate limited spaced residential home fronts/commercial properties. In another embodiment of the present invention, the controller can be programmed to manipulate the driver and the first door, such that the first door partially closes upon the deployed bin such that the partially traversed sheet blocks the bin from traversing from the first frame. The driver then retracts and houses the shuttle back into the cavity, where the blocked bin will shear off the tray and ramp portions of the shuttle. The first door can then fully close when the shuttle is housed back into the cavity, thus ejecting the bin for waste pick-up.

Figure 11:
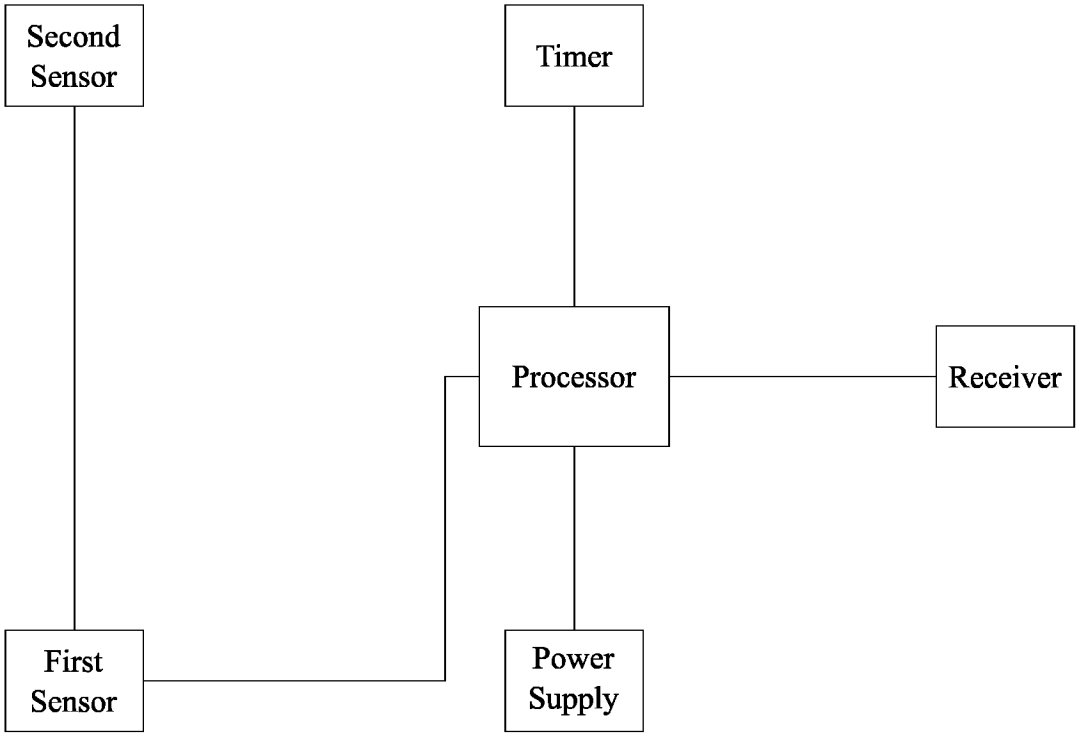
FIG. 11 is a diagram view depicting various electronic components of the present invention in some embodiments.

The controller further comprises: a receiver, a processor, a timer, and a power supply. In reference to FIG. 11, the receiver is wired into the controller module. More specifically, the receiver serves as the wireless communicator of the controller assembly, such that it wirelessly links the holder assembly to the cloud. In the preferred embodiment of the present invention, the receiver can take form of a: Wi-Fi, Bluetooth, and/or any other wireless receiver. The processor is wired into the controller module. More specifically, the processor refines data received from the cloud to functions that can manipulate the driver, and the spool actuators. The timer is wired into the controller module. More specifically, the timer serves as a switch that activates processor functions of the controller to open the first door, and/or move the shuttle on a scheduled basis.

The power supply is wired into the controller. More specifically, the power supply regulates and/or distributes electrical input into the controller assembly, the spool, and/or the driver. The power supply further comprises a port. The port serves as the electrical input source of the power supply. In various embodiments of the present invention, the port can be a plug-in, battery, solar panel, and/or a combination of any viable means to provide power to the holder assembly.

Figure 12:
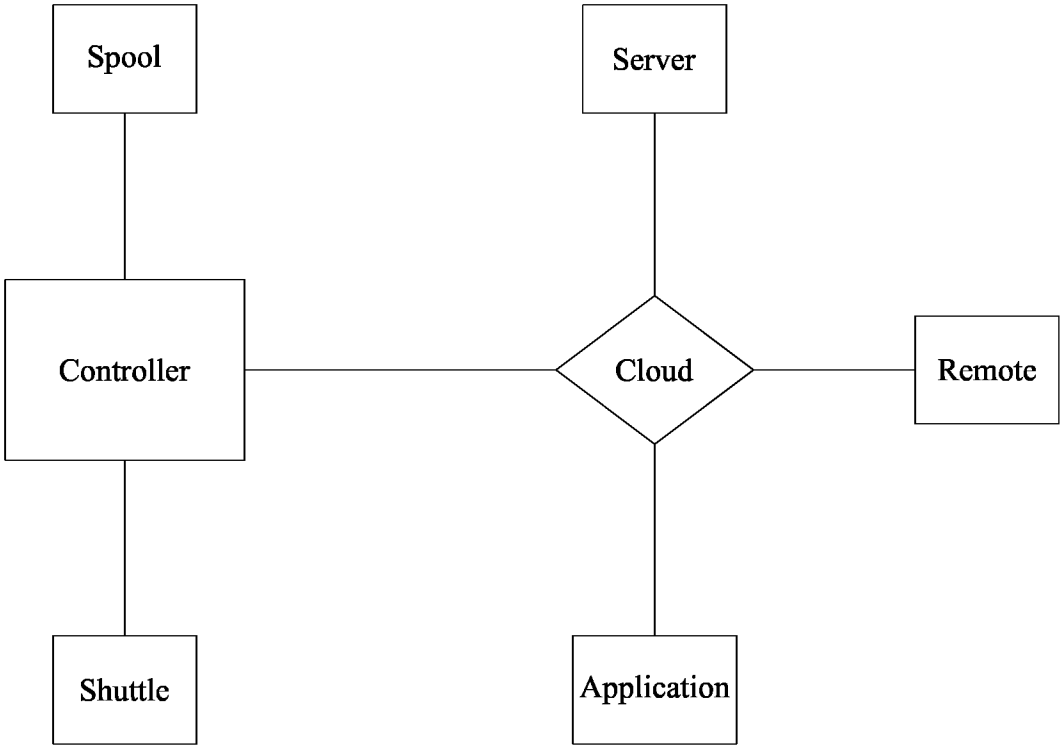
FIG. 12 is a diagram view depicting the network of the present invention in some embodiments.

In reference to FIG. 12, the cloud is paired to the controller module. More specifically, the cloud is the programmable dashboard of the holder assembly that allows users to set schedules, and/or manipulate the holder assembly wirelessly. The cloud comprises: a server, an application, and a remote. The server is linked to the cloud. More specifically, the server is the database module of the holder assembly that stores and saves programmed commands such that the holder assembly can autonomously deploy the bin out for waste pick-up at a set schedule. The application is linked to the cloud and the server. More specifically, the application is the mobile application dashboard that allows the user to view, and/or edit programmed commands of manipulating the holder assembly. The remote is linked to the cloud. More specifically, the remote is a dedicated transponder agent that serves as a manual overdrive of the holder assembly. In the preferred embodiment of the present invention, the remote will be integrated within the application. In another embodiment of the present invention, the remote can be a dedicated piece of hardware that wirelessly manipulates the holder assembly.

Although the invention has been explained in relation to its preferred embodiment, it is to be understood that many other possible modifications and variations can be made without departing from the spirit and scope of the invention as hereinafter claimed.

What is claimed is:

1. An automated waste collection system comprises:

a housing;

a deployment mechanism;

a deployment actuator;

a deployment closure;

an access closure;

a lid;

a controller;

a power source;

the housing comprises a base, a top, a deployment opening, an access opening, and a lid opening;

the top being positioned opposite the base along the housing;

the deployment opening and the access opening traversing longitudinally through the housing between the base and the top;

the deployment opening and the lid opening being positioned longitudinally opposite each other along the housing;

the lid opening traversing through the top;

the deployment closure being connected to the housing adjacent to the deployment opening, wherein the deployment closure is configured to selectively obstruct the deployment opening;

the access closure being connected to the housing adjacent to the access opening, wherein the access closure is configured to selectively obstruct the access opening;

the lid being positioned adjacent to the lid opening, wherein the lid is configured to selectively obstruct the lid opening;

the deployment mechanism being operatively engaged with the housing between a stored position and an deployed position, wherein the deployment mechanism is positioned within the housing in the stored position, wherein the deployment mechanism is positioned external to the housing in the deployed position, wherein the deployment mechanism is configured to displace a waste bin through the deployment opening between the stored position and the deployed position;

the deployment actuator being operatively engaged between the housing and the deployment mechanism, wherein the deployment actuator is configured to longitudinally displace the deployment mechanism between the stored position and the deployed position;

the power source being electrically connected to the deployment actuator and the controller; and the controller being electronically connected to the deployment actuator.

2. The automated waste collection system as claimed in claim 1 comprises:

the deployment mechanism being a deployment tray;

the deployment tray being positioned adjacent to the base;

the deployment tray being slidably engaged with the housing between a stored position and an deployed position, wherein the deployment tray is positioned within the housing in the stored position, wherein the deployment tray is positioned external to the housing in the deployed position, and wherein the deployment tray traverses through the deployment opening between the stored position and the deployed position;

the deployment actuator being operatively engaged between the housing and the deployment tray, wherein the deployment actuator is configured to longitudinally displace the deployment tray between the stored position and the deployed position.

3. The automated waste collection system as claimed in claim 1 comprises:

the housing further comprises a deployment frame, an access frame, a first lateral wall, and a second lateral wall;

the deployment frame, the access frame, the first lateral wall, and the second lateral wall being connected between the base and the top;

the deployment frame and the access frame being oriented parallel to each other;

the first lateral wall and the second lateral wall being oriented parallel to each other;

the first lateral wall and the second lateral wall being perpendicularly and terminally connected between the deployment frame and the access frame;

the deployment closure traversing through the deployment frame; and the access closure traversing through the access frame.

4. The automated waste collection system as claimed in claim 3 comprises:

the deployment closure comprises a closure body and a motorized spool, wherein the deployment closure is an unfurling closure;

the closure body being deployably wound around the motorized spool, wherein the motorized spool is configured to deploy the closure body in order to obstruct the deployment opening, and wherein the motorized spool is configured to reversibly rotate in order to deploy and retract the closure body;

the motorized spool being electrically connected to the power source; and the motorized spool being electronically connected to the controller.

5. The automated waste collection system as claimed in claim 4 comprises:

the motorized spool being laterally mounted within the housing adjacent to the deployment frame and adjacent to the top.

6. The automated waste collection system as claimed in claim 5 comprises:

the deployment frame comprises a pair of tracks;

the pair of tracks traversing into the deployment frame between the top and the base;

the pair of tracks being positioned laterally opposite each other along the deployment frame; and a distal end of the closure body being positioned within the pair of tracks, wherein the motorized spool is configured to displace the distal end of the closure body toward the base within the pair of tracks in order to obstruct the deployment opening.

7. The automated waste collection system as claimed in claim 3 comprises:

the deployment closure comprises at least one a motorized door, wherein the at least one motorized door is configured to move between a closed position and an opened position, wherein the deployment closure is obstructed by the at least one motorized door in the closed position;

the motorized door being electrically connected to the power source; and the motorized door being electronically connected to the controller.

8. The automated waste collection system as claimed in claim 7 comprises:

the deployment frame comprises a pair of hinges;

the at least one motorized door comprises a pair of motorized doors;

the pair of hinges being connected to the deployment frame between the top and the base;

the pair of hinges being positioned laterally opposite each other along the deployment frame; and each of the pair of motorized doors being hingedly connected to the deployment frame through one of the pair of hinges.

9. The automated waste collection system as claimed in claim 1 comprises:

the lid being hingedly connected to the top, wherein the lid is configured to selectively obstruct the lid opening.

10. The automated waste collection system as claimed in claim 1 comprises:

a plurality of rails;

the deployment mechanism being a deployment tray;

the plurality of rails being oriented longitudinally and connected within the housing; and the deployment tray being slidably engaged with the plurality of rails, wherein the deployment tray is displaced between the stored position and the deployed position along the plurality of rails.

11. The automated waste collection system as claimed in claim 10 comprises:

each of the plurality of rails being laterally connected internally to the base.

12. The automated waste collection system as claimed in claim 1 comprises:

at least one closure hinge;

the at least one closure hinge being connected to an access frame of the housing adjacent to the access opening; and the access closure being hingedly connected to the housing through the at least one closure hinge.

13. The automated waste collection system as claimed in claim 1 comprises:

a closure handle;

the closure handle being connected to the access closure; and the closure handle being positioned external to the housing.

* * * * *